US005713472A

United States Patent [19]

Howell et al.

[11] Patent Number: 5,713,472

[45] Date of Patent: Feb. 3, 1998

[54] FOLDING CARTON WITH A REINFORCED HANG TAB

[75] Inventors: George L. Howell, Elmira; Michael Paliotta, Horseheads, both of N.Y.

[73] Assignee: F. M. Howell & Company, Elmira, N.Y.

[21] Appl. No.: 658,131

[22] Filed: Jun. 4, 1996

[51] Int. Cl.[6] ..... B65D 69/00

[52] U.S. Cl. ..... 206/784; 206/806

[58] Field of Search ..... 206/784, 806, 206/775, 756, 763

[56] References Cited

U.S. PATENT DOCUMENTS

| | | | |
|---|---|---|---|
| 735,013 | 7/1903 | Bauer . | |
| 1,577,556 | 3/1926 | Bergstein et al. . | |
| 1,616,677 | 2/1927 | Bergstein . | |
| 1,743,502 | 1/1930 | Tanner . | |
| 1,969,428 | 8/1934 | Schwartz | 206/806 X |
| 2,833,457 | 5/1958 | Tyrseck . | |
| 3,799,332 | 3/1974 | Jeronimus . | |
| 3,946,936 | 3/1976 | Brown . | |
| 4,207,978 | 6/1980 | Patterson et al. | 206/806 X |
| 4,413,730 | 11/1983 | Morse . | |
| 4,447,004 | 5/1984 | House et al. . | |
| 4,468,212 | 8/1984 | Jennings . | |
| 5,117,973 | 6/1992 | Lo Duca . | |
| 5,263,586 | 11/1993 | Keable . | |
| 5,363,981 | 11/1994 | Giblin et al. . | |

*Primary Examiner*—Jacob K. Ackun

*Attorney, Agent, or Firm*—Arent, Fox, Kintner, Plotkin & Kahn

[57] ABSTRACT

A carton blank including a reinforced hang tab. The hang tab includes a tab having an upper portion, a top edge defined by a fold line and a cutout formed in the upper portion. A foldover panel is connected to the tab at the fold line. The foldover panel has first and second side flaps and a middle bridge portion that define a notch formed in the foldover panel. Upon assembly, the foldover panel is folded along the fold line and secured to the tab so that the notch overlaps the tab cutout to form a reinforced hang tab with an opening formed therein. The first and second side flaps and the middle bridge portion of the foldover panel reinforce the opening and the upper portion of the upper tab to prevent the tab from easily ripping or breaking. The lower tab that is secured to the bottom portion of the upper tab is configured to correspond to the notch in the foldover panel.

6 Claims, 3 Drawing Sheets

FOLDING CARTON WITH A REINFORCED HANG TAB

BACKGROUND OF THE INVENTION

1. Field of the Invention

The present invention relates to a one-piece folding carton blank having a foldover hang tab. More specifically, the invention relates to a one-piece carton with a reinforcing hang tab formed in such a shape that it allows nesting of carton blanks during manufacture. This provides reinforced strength to support the carton in a hanging position by doubling the thickness of the material at the weight-bearing side of the hang hole, yet minimizes the amount of material required. Such cartons are used to package various consumer products at retail point of sale, such as camera film, pharmaceutical products, health and beauty products and toys. Hang tabs are incorporated in the carton structure to display the cartons, for example on hooks in retail stores such as drugstores and supermarkets.

2. Related Art

U.S. Pat. No. 3,799,332 to Jeronimus and U.S. Pat. No. 5,117,973 to Lo Duca teach conventional carton blanks including panels or sections that are folded and secured in place to form a carton. These carton blanks include a single-layer top tab that serves as a lid for the carton during shipment and can be opened to display the carton contents for sale.

Such folding cartons are typically manufactured from paperboard or other paper or plastic products and are either disposable or recyclable. Since such cartons are disposable, it is a goal of the prior art design discussed above to produce cartons in large quantities at reduced cost. However, the resulting hanging tab is structurally weak, and prone to tearing, bending or breaking.

An alternative conventional carton blank 100 having a hanging tab 130 is illustrated in FIGS. 5 and 6. As shown in FIG. 6, carton blank 100 includes top, front, bottom and rear carton panels 142, 146, 148 and 150, respectively, separated by first, second, third and fourth carton fold lines 132, 134, 136 and 138, respectively. First, second, third and fourth carton fold lines 132, 134, 136 and 138 are parallel to each other and transverse to the longitudinal axis of carton blank 100, shown as line b in FIG. 6. First and second parallel flap fold lines 154 and 156 are parallel to each other and to the longitudinal axis (line b) of carton blank 100 and are transverse to first, second, third and fourth carton fold lines 132, 134, 136 and 138. First and second parallel flap fold lines 154, 156 define first and second top side flaps 158, 160; first and second front side flaps 162, 164; first and second bottom side flaps 166, 168; and first and second rear side flaps 170, 172.

To assemble carton 180, carton blank 100 is folded along first carton fold line 132 so that top carton panel 142 extends perpendicularly outward from upper tab 112. Then, carton blank 100 is folded along second carton fold line 134 so that front carton panel 146 extends perpendicularly downward from top carton panel 142 and is parallel to upper tab 112. Next, carton blank 100 is folded along third carton fold line 136 so that bottom carton panel 148 extends perpendicularly outward from front carton panel 146 and is parallel to top carton panel 142. Finally, carton blank is folded along fourth carton fold line 138 so that rear carton panel 150 extends perpendicularly upward from bottom carton panel 148 and is parallel to front carton panel 146. Lower tab 114 is secured to upper tab 112, for example by an adhesive such as glue, to secure carton 180 in place.

First and second top side flaps 158, 160 are folded along first and second flap fold lines 154, 156, respectively, so that first and second top side flaps extend perpendicularly downward from top carton panel 142 and are parallel to each other. First and second bottom side flaps 166, 168 are then folded along first and second flap fold lines 154, 156 so that first and second bottom side flaps 166, 168 extend perpendicularly upward from bottom carton panel 148, are parallel to each other, and overlap first and second top side flaps 158, 160, respectively. Similarly, first and second rear side flaps 170, 172 are folded along first and second flap fold lines 154, 156 so that they overlap first and second bottom side flaps 166, 168 and are parallel to each other. Finally, first and second from side flaps 166, 168 are folded along first and second flap fold lines 154, 156 so that they overlap first and second rear side flaps 170, 172 and are secured in place to form carton 180, shown in FIG. 5.

An upper tab 112 having a foldover panel 118 and a lower tab 114 together form a double-layer hanging tab 130 when carton 180 is assembled. Foldover panel 118 is connected to upper tab 112 along hanging tab fold line 124, which is transverse to the longitudinal axis (line b) of carton blank 100. Cutouts 120 and 122 are formed in top hanging panel 112 and foldover tab 118, respectively. Upon assembly, foldover panel 118 is folded along hanging tab fold line 124 and secured to upper tab 112 to form double-layer hanging tab 130. Cutouts 120, 122 overlap to form an opening 126 in hanging tab 130 from which carton 180 can be hung. Providing a double-layer hanging tab 130 with cutouts 120, 122 in top panel 112 and foldover tab 118, respectively, creates a relatively strong, reinforced hanging tab capable of supporting the weight of carton 180 in a hanging position. However, this structure requires more material and higher production costs than single-layer panels.

Therefore, it is desirable to provide a carton blank with a reinforced single-layer hanging tab formed from a minimal amount of material yet having sufficient strength to support the carton in a hanging position to reduce production and material costs.

SUMMARY OF THE INVENTION

The present invention provides a carton blank for a product display carton having a reinforced hang tab that is manufactured using a minimal amount of material yet has sufficient strength to support the carton in a hanging position.

The inventive carton blank includes a series of transverse and parallel fold lines that define top, front, bottom and rear carton panels and first and second top, front, bottom and rear side flaps. The reinforced hang tab is formed by an upper tab, foldover panel and lower tab assembly.

The foldover panel is connected to the upper tab along a hang tab fold line. The upper tab includes a hang hole and the foldover panel includes first and second foldover panel side flaps and a middle bridge portion that define a notch configured to at least partially overlap the upper tab hang hole when the foldover panel is folded along the hang tab fold line and secured to the upper tab. The lower tab is shaped so that it corresponds to the foldover panel notch and can nest therein. This allows carton blanks to be formed from a single strip of material with minimal waste. In addition, this structure allows carton blanks to be compactly stacked and stored one on top of the other by alternating the orientation of adjacent carton blanks in a stack.

When the carton is assembled, the bottom tab is attached to the lower rear face of the upper tab to secure the carton in place. The foldover panel is folded along the hang tab fold line and secured to the upper rear face of the upper tab to form the reinforced hang tab having an opening formed therein. The first and second foldover panel side flaps reinforce the side portion of the opening and the middle bridging portion reinforces the upper edge of the opening.

BRIEF DESCRIPTION OF THE DRAWINGS

The invention is better understood by reading the following Detailed Description of the Preferred Embodiments with reference to the accompanying drawing figures, in which like reference numerals refer to like elements throughout, and in which.

DETAILED DESCRIPTION OF THE PREFERRED EMBODIMENTS

Figure 1:
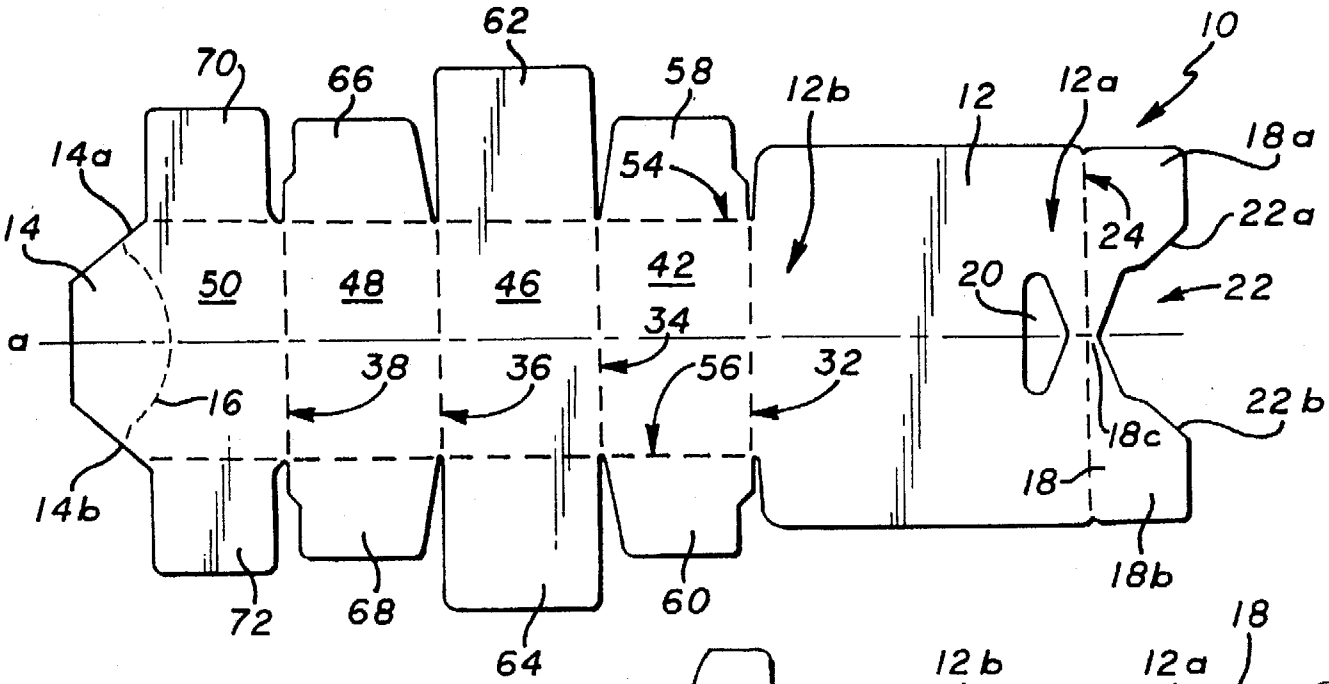
FIG. 1 is a top plan view of the inventive carton blank.

In describing preferred embodiments of the present invention illustrated in the drawings, specific terminology is employed for the sake of clarity. However, the invention is not intended to be limited to the specific terminology so selected, and it is to be understood that each specific element includes all technical equivalents that operate in a similar manner to accomplish a similar purpose.

As illustrated in FIG. 1, carton blank 10 includes top, front, bottom and rear carton panels 42, 46, 48 and 50, respectively, separated by first, second, third and fourth carton fold lines 32, 34, 36 and 38, respectively. First, second, third and fourth carton fold lines 32, 34, 36 and 38 are transverse to the longitudinal axis of carton blank 10, shown as line a. An upper tab 12, foldover panel 18 and lower tab 14 together form a reinforced hang tab 30, discussed in detail below.

First and second flap fold lines 54 and 56 are parallel to each other and to the longitudinal axis (line a) of carton blank 10 and are transverse to first, second, third and fourth carton fold lines 32, 34, 36 and 38. First and second flap fold lines 54, 56 define first and second top side flaps 58, 60; first and second front side flaps 62, 64; first and second bottom side flaps 66, 68; and first and second rear side flaps 70, 72.

To assemble carton 80 with reference to its position of intended use, carton blank 10 is folded along first carton fold line 32 so that top carton panel 42 extends perpendicularly outward from upper tab 12. Then, carton blank 10 is folded along second carton fold line 34 so that front carton panel 46 extends perpendicularly downward from top carton panel 42 and is parallel to upper tab 12. Next, carton blank 10 is folded along third carton fold line 36 so that bottom carton panel 48 extends perpendicularly outward from front carton panel 46 and is parallel to top carton panel 42. Finally, carton blank is folded along fourth carton fold line 38 so that rear carton panel 50 extends perpendicularly upward from bottom carton panel 48 and is parallel to front carton panel 46. Lower tab 14 is secured to a bottom portion **12*b* of rear face 12' of upper tab 12, for example by an adhesive such as glue, to secure carton 80** in place.

First and second top side flaps 58, 60 are folded along first and second flap fold lines 54, 56, respectively, so that first and second top side flaps extend perpendicularly downward from top carton panel 42 and are parallel to each other. First and second bottom side flaps 66, 68 are then folded along first and second flap fold lines 54, 56 so that first and second bottom side flaps 66, 68 extend perpendicularly upward from bottom carton panel 48, are parallel to each other, and overlap first and second top side flaps 58, 60, respectively. Similarly, first and second rear side flaps 70, 72 are folded along first and second flap fold lines 54, 56 so that they overlap first and second bottom side flaps 66, 68 and are parallel to each other. Finally, first and second front side flaps 62, 64 are folded along first and second flap fold lines 54, 56 so that they overlap first and second rear side flaps 70, 72 and are secured in place to form carton 80, for example by an adhesive such as glue.

Figure 2:
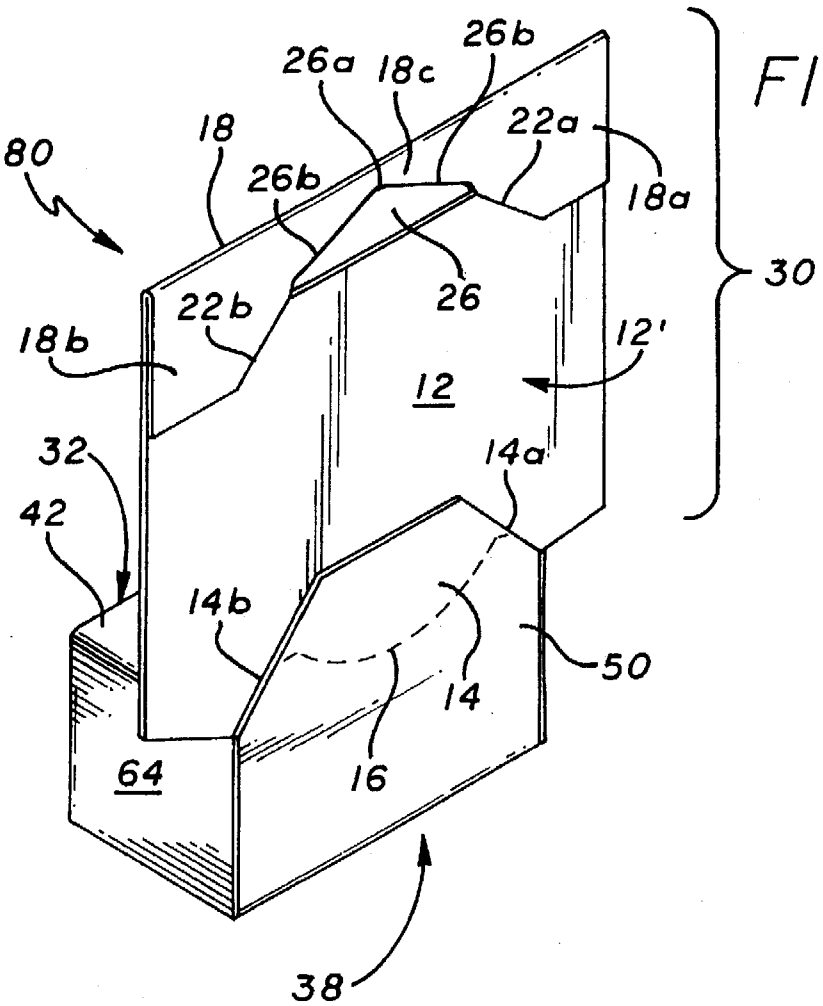
FIG. 2 is a perspective view of an assembled carton made from the blank of FIG. 1.
Figure 5:
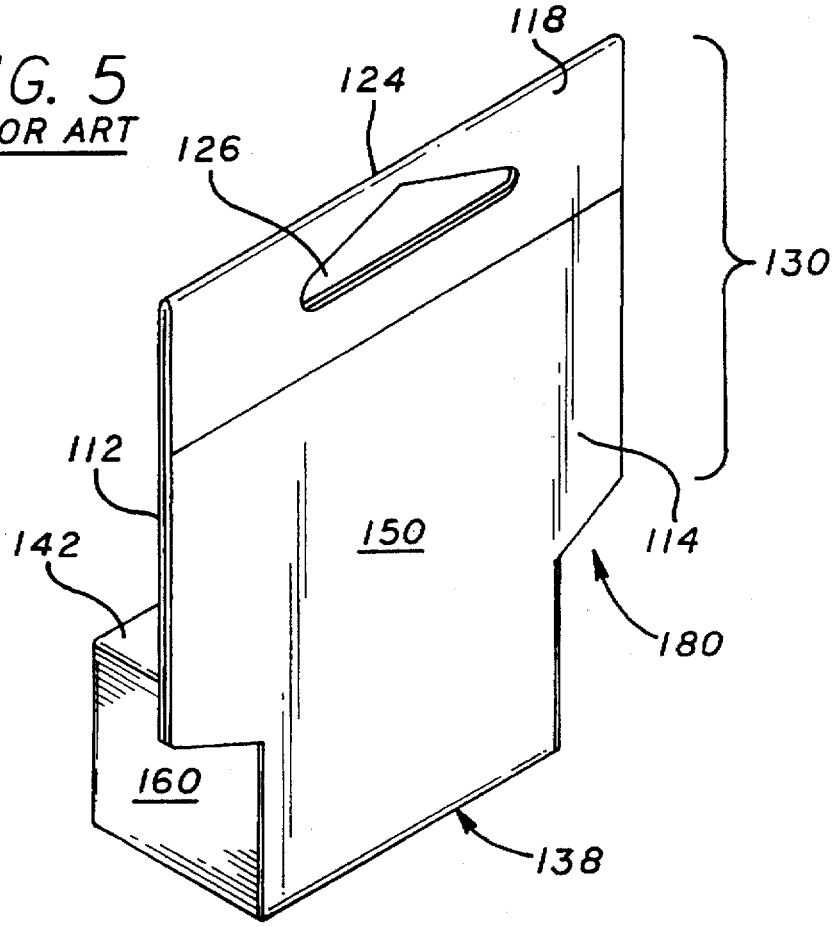
FIG. 5 PRIOR ART
FIG. 5 shows an assembled prior art carton blank.
Figure 6:
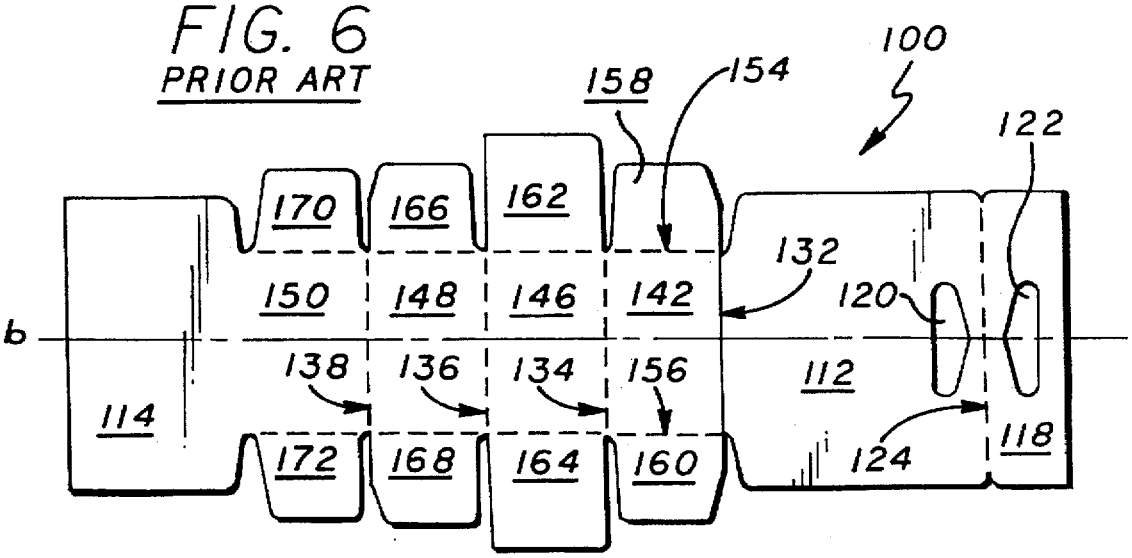
FIG. 6 PRIOR ART
FIG. 6 is a top plan view of the prior art carton blank of FIG. 5.

As shown in FIG. 2, upper tab 12, foldover panel 18 and lower tab 14 together form the reinforced hang tab 30 when the carton 80 is assembled. Foldover panel 18 is connected to upper tab 12 along hang tab fold line 24, which is transverse to the longitudinal axis (line a) of carton blank 100. Upper tab 12 has a hang hole 20 therein. Hang hole 20 can be triangular, as shown in FIG. 1, or any other shape suitable for hanging carton 80, such as circular, square or rectangular. Foldover panel 18 has a notch 22 formed therein. Notch 22 is defined by first and second foldover panel side flaps **18*a*, 18*b* and middle bridge portion 18*c* of foldover panel 18. Preferably, notch 22 is configured so that when foldover panel 18 is folded along hang tab fold line 24, notch 22 overlaps hang hole 20 at least partially and notch 22 and hang hole 20 together form an opening 26 in the hang tab 30**.

Upon assembly, foldover panel 18 is folded along hang tab fold line 24 and first and second foldover panel side flaps **18*a*, 18*b* and middle bridge portion 18*c* of foldover panel 18 are secured to an upper portion 12*a* of rear face 12' of upper tab 12, for example by an adhesive such as glue, to form hang tab 30. As discussed above, notch 22 and hang hole 20 together form opening 26 in hang tab 30. Middle bridge portion 18*c* reinforces the upper edge portion 26*a* of opening 26 to prevent ripping and breaking of hang tab 30 during hanging and display. First and second foldover panel side flaps 18*a*, 18*b* reinforce side portion 26*b* of opening 26 as well as upper portion 12*a* of upper tab 12. This structure reinforces hang tab 30** to prevent it from easily bending or breaking.

Lower tab 14 is attached to bottom portion **12*b* of rear face 12' of upper tab 12, for example by an adhesive such as glue, to secure carton 80 in place. The resulting hang tab 30 is a single-layer tab that is reinforced only at its upper and lower portions 12*a*, 12*b* by foldover panel 18 and lower tab 14, respectively. This provides a hang tab 30 having sufficient strength to support carton 80 when hung from opening 26 using a minimal amount of material at reduced cost. Lower tab 14 may include a perforated line 16 to facilitate the opening of carton 80**.

Figure 3:
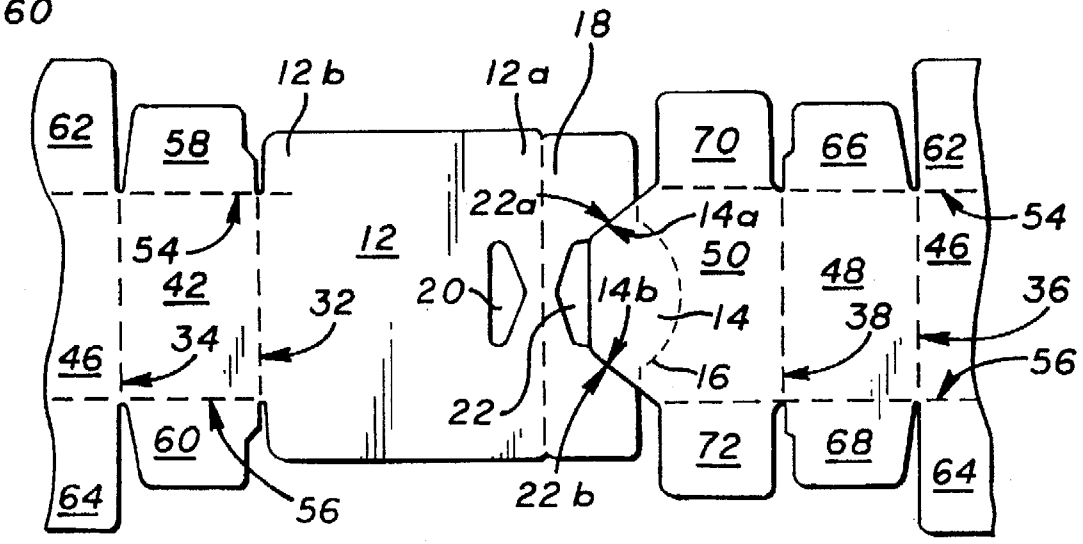
FIG. 3 is a plan view of a pair of nested carton blanks.
Figure 4:
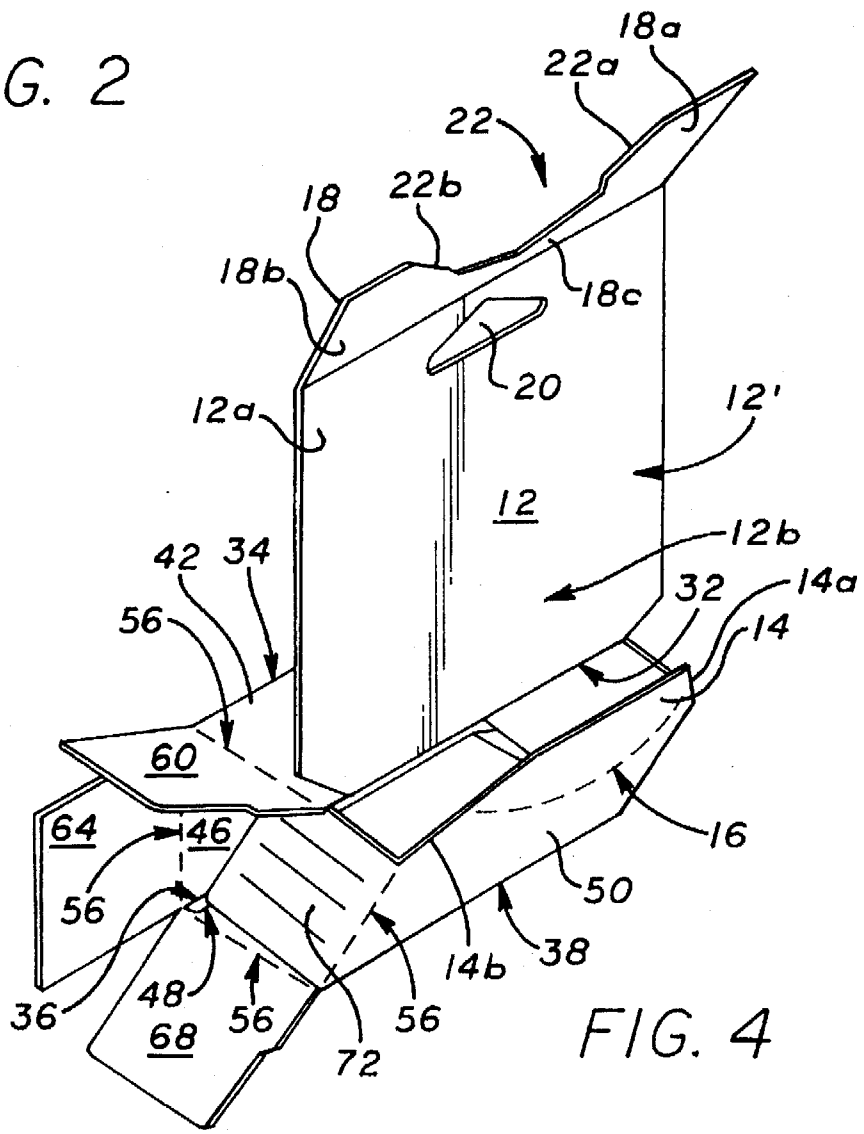
FIG. 4 is a perspective view of a partially assembled carton blank of FIG. 1.

Lower tab 14 has a configuration corresponding to that of notch 22 so that lower tab 14 of one carton blank can nest in notch 22 of an adjacent carton blank during manufacture, as shown in FIG. 3. Specifically, first and second side edges **14*a*, 14*b* of lower tab 14 abut first and second side edges 22*a*, 22*b* of notch 22 of an adjacent carton blank when two blanks are nested together. Thus, when cutout 22 for one carton blank is being formed, lower tab 14** of an adjacent carton blank is simultaneously formed. This allows manufacture of carton blanks at reduced cost with minimal waste of material.

Modifications and variations of the above-described embodiments of the present invention are possible, as appreciated by those skilled in the art in light of the above teachings. For example, upper tab 12, hang hole 20 and notch 22 may be formed in various shapes, such as square, rectangular, circular, oval or triangular.

In addition, application of the inventive reinforced hang tab is not limited to carton blanks. The hang tab may be incorporated in backing panels used to package various products. For example, the hang tab can be incorporated into backing panels used with plastic blister packs, backing panels having holes through which products are fed and secured, or backing panels that include twist-ties to secure objects in place. The present invention provides a reinforced hang tab that uses less material than a conventional reinforced double-layer hang tab. Further, cutting the foldover panel for one backing panel automatically defines an edge portion of an adjacent backing panel during manufacture. This reduces production and material costs.

It is therefore to be understood that, within the scope of the appended claims and their equivalents, the invention may be practiced otherwise than as specifically described.

What is claimed is:

1. A carton blank for forming a carton, comprising:

a carton-forming portion including first, second, third and fourth parallel panel fold lines that define top, front, bottom, and rear carton panels, and a pair of first and second parallel flap fold lines perpendicular to said panel fold lines, said first and second parallel flap fold lines defining first and second top, front, bottom and rear side flaps connected to said top, front, bottom and rear carton panels, respectively;

an upper tab having an upper portion, a cutout formed in said upper portion, a top edge defined by a hang tab fold line, and a bottom portion;

a foldover panel connected to said upper tab at said hang tab fold line, said foldover panel having first and second side flap portions and a middle bridge portion, said first and second side flap portions and said middle bridge portion defining a notch formed in said foldover panel; and a lower tab connected to said rear carton panel;

wherein said foldover panel is folded along said hang tab fold line and secured to said upper tab to form a hang tab, said notch overlapping said upper tab cutout to form an opening in said hang tab, so that said first and second side flap portions and said middle bridge portion of said foldover panel reinforce said opening and said upper portion of said upper tab; and wherein said carton blank is folded along said first, second, third and fourth panel fold lines and said first and second top, front, bottom and rear side flaps are folded along said first and second flap fold lines to form a carton; and said lower tab is secured to said bottom portion of said upper tab to secure said carton in place.

2. The carton blank of claim 1, wherein said lower tab is configured to correspond to said notch in said foldover panel.

3. The carton blank of claim 1, wherein said lower tab includes a perforated line.

4. A carton blank for folding a carton, comprising:

a carton-forming portion including a series of panel fold lines that define carton panels including a rear carton panel and first and second parallel flap fold lines transverse to the panel fold lines, the first and second parallel flap fold lines defining side flaps connected to each of the carton panels;

an upper tab having an upper portion, a cutout formed in the upper portion, a top edge defined by a hang tab fold line, and a bottom portion;

a foldover panel connected to the upper tab at the hang tab fold line, the foldover panel having first and second side flap portions and a middle bridge portion, the first and second side flap portions and the middle bridge portion defining a notch formed in the foldover panel; and a lower tab connected to the rear carton panel;

wherein the foldover panel is folded along the hang tab fold line and secured to the upper tab to form a hang tab, the notch overlapping the upper tab cutout to form an opening in the hang tab, so that the first and second side flap portions and the middle bridge portion of the foldover panel reinforce the opening and the upper portion of the upper tab; and wherein the carton blank is folded along the panel fold lines and the side flaps are folded along the first and second flap fold lines to form a carton; and the lower tab is secured to the bottom portion of the upper tab to secure the carton in place.

5. The carton blank of claim 4, wherein the lower tab is configured to correspond to the notch in the foldover panel.

6. The carton blank of claim 5, wherein the lower tab includes a perforated line.

* * * * *